US006349698B2

(12) United States Patent
Park

(10) Patent No.: US 6,349,698 B2
(45) Date of Patent: Feb. 26, 2002

(54) INJECTION PRESSURE CONTROLLING METHOD OF GASOLINE DIRECT INJECTION ENGINE

(75) Inventor: Yong-Jung Park, Suwon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/748,595

(22) Filed: Dec. 22, 2000

(30) Foreign Application Priority Data

Dec. 28, 1999 (KR) ..... 99-63712

(51) Int. Cl.[7] ..... F02B 17/00
(52) U.S. Cl. ..... 123/295; 123/435; 123/458
(58) Field of Search ..... 123/295, 435, 123/457, 458

(56) References Cited

U.S. PATENT DOCUMENTS 4,667,634 A * 5/1987 Matsumura et al. ..... 123/435
4,704,999 A * 11/1987 Hashikawa et al. ..... 123/435
5,313,920 A * 5/1994 Matsushita ..... 123/295
5,313,924 A * 5/1994 Regueiro ..... 123/458

* cited by examiner

*Primary Examiner*—Erick Solis
(74) *Attorney, Agent, or Firm*—Christie, Parker & Hale, LLP

(57) ABSTRACT

In an injection pressure control method of a GDI engine, an engine torque and an engine rpm are detected, then an initial stratified mode fuel pressure value is set according to the detected engine torque and engine rpm. Next, a weighting factor is calculated according to a variation rate in effective pressure of a combustion chamber of the engine, and a corrected stratified mode fuel pressure value is established by multiplying the wighting factor to the initial stratified mode fuel pressure value. Then, the corrected stratified mode fuel pressure value is compared with a current fuel pressure value, then a final fuel pressure value is obtained according to the comparision result.

4 Claims, 3 Drawing Sheets

INJECTION PRESSURE CONTROLLING METHOD OF GASOLINE DIRECT INJECTION ENGINE

CROSS-REFERENCE TO RELATED APPLICATION

This application claims priority of Korea patent Application No. 99-63712, filed on Dec. 28, 1999.

BACKGROUND OF THE INVENTION (a) Field of the Invention

The present invention relates to a gasoline direct injection (GDI) engine, and more particularly, to an injection pressure control method of a GDI engine.

(b) Description of the Related Art

Generally, internal combustion engines are operated by supplying an air/fuel mixture into a cylinder, and compressing and igniting the mixture. A procedure for generating power in internal combustion engines to drive a vehicle comprises the steps of supplying air through an air supply system, injecting fuel such that it can mix with the air during an intake stroke, injecting the air-fuel mixture into a vaporization portion, igniting the mixture using a spark plug, and exhausting burned gas through an exhaust system.

Recently, much research and development has been pursued for improving fuel consumption and reducing emissions utilizing direct injection internal combustion engines.

Generally, a direct injection engine adopts a swirl air intake mechanism for quickly producing an air/fuel mixture and directly injects fuel into the combustion chamber at a predetermined pressure according to the valve timing of the valve system.

FIG. 3 schematically shows a conventional direct fuel injection mechanism. The fuel stored in a fuel tank 112 having a pressure of about 3 bar is increased in pressure to about 120 bar by a high-pressure pump 114, then supplied to a fuel rail 118 through a fuel pipe 116, and injected into a combustion chamber 122 through an injector 120.

At this point, pressure of the fuel supplied to the fuel rail 118 is detected by a pressure sensor 124, then output to an electronic control unit (ECU) which is not shown in the drawing. The ECU controls a pressure control valve 126 according to the detected pressure such that the pressure control valve 126 adjusts the fuel pressure in a range of 40–120 bar according to engine operation modes (i.e., a stratified charge mode and a homogenous charge mode). For example, the ECU controls the pressure control valve 126 such that the fuel pressure is reduced to prevent fuel concentration in the stratified charge mode and is increased to prevent dispersion of the fuel in the homogenous charge mode.

Generally, in such direct fuel injection engines, a continuous variable valve timing (CVVT) mechanism is employed to continuously vary the valve timing and the valve lift according to the drive conditions of the vehicle. Accordingly, the effective compression ratio within a combustion chamber is varied together with the variation of intake valve timing as the injection is realized during a compression stroke in the stratified mode.

In this case, as only the engine torque and the engine RPM are considered to determine the injection pressure in the stratified charge mode, the fuel injection cannot be optimally performed. That is, since the variation of the effective compression ratio in a combustion chamber is not considered, an appropriate fuel injection amount and time cannot be realized, resulting in increased emission gasses and degraded driving quality.

SUMMARY OF THE INVENTION

Therefore, the present invention has been made in an effort to solve the above problems.

It is an objective of the present invention to provide an injection pressure control method for a GDI engine capable of optimizing a fuel injection amount by setting a pressure value in consideration of a compression ratio variation rate in a combustion chamber when a variable valve timing mechanism is employed.

To achieve the above objective, the present invention provides an injection pressure control method of a GDI engine comprising the steps of detecting an engine torque and an engine rpm; setting an initial stratified mode fuel pressure value according to the detected engine torque and engine rpm; calculating a weighting factor according to a variation rate in effective pressure of a combustion chamber of the engine; establishing a corrected stratified mode fuel pressure value by multiplying the wighting factor to the initial stratified mode fuel pressure value; comparing the corrected stratified mode fuel pressure value with a current fuel pressure value; and calculating a final fuel pressure value according to the comparision result.

The step of calculating the weighting factor comprises the steps of dividing a variable compression section of a crankshaft rotation angle into a predetermined number of unit sections; detecting a variation ratio in the effective pressure in the unit sections; and setting the variation ratio as the weighting factor.

The variable compression section is within a range of 40–60° of a crank angle after bottom dead center.

The predetermined number of unit sections is about 20.

DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

A preferred embodiment of the present invention will now be described in detail with reference to the accompanying drawings.

Figure 1:
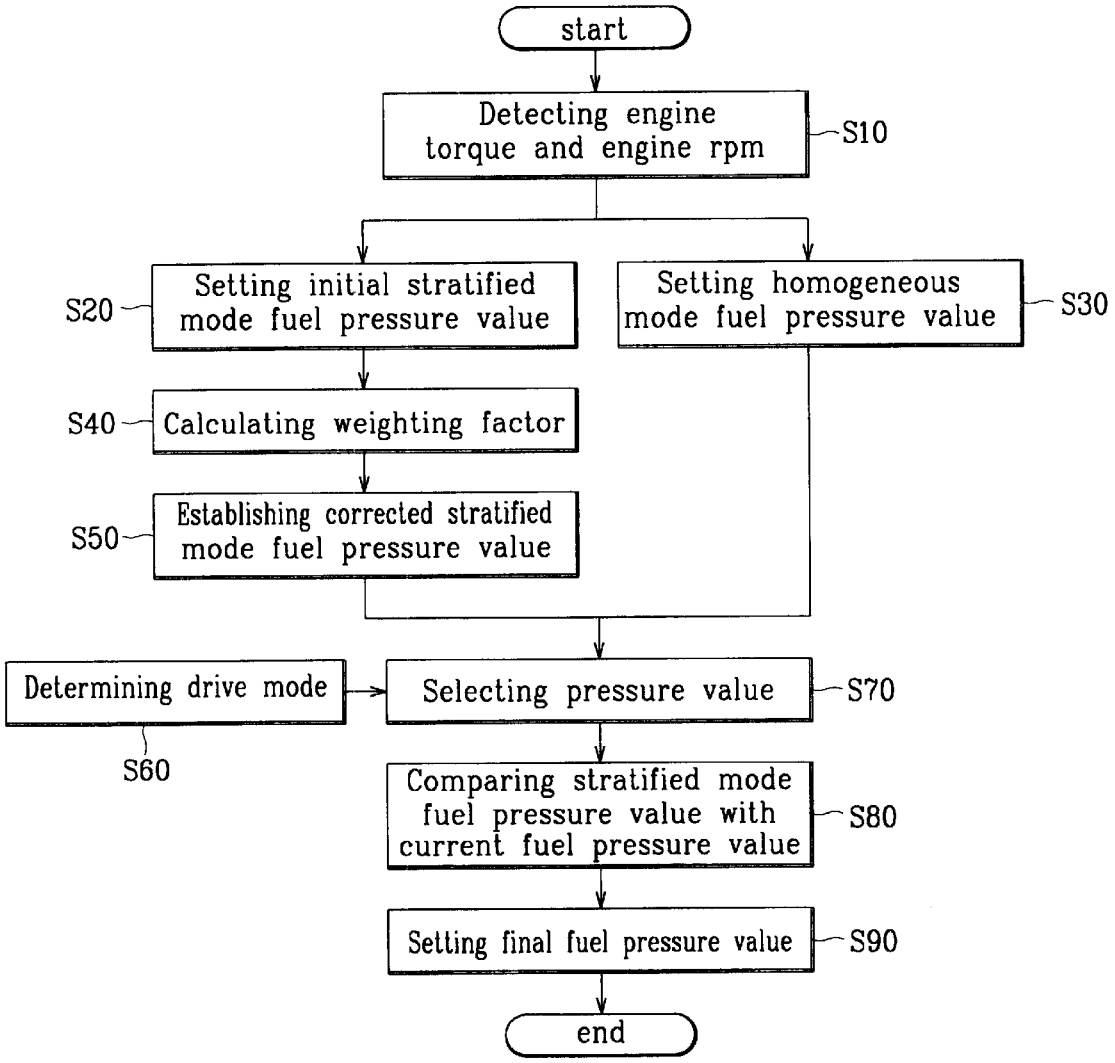
FIG. 1 is a flow chart illustrating an injection pressure control method according to a preferred embodiment of the present invention.

FIG. 1 shows respectively a schematic diagram and a flow chart relating to an injection pressure control method according to a preferred embodiment of the present invention.

When a GDI engine operates, an engine torque and an engine rpm are first detected (S10). According to the detected engine torque and the engine rpm, an initial stratified mode fuel pressure value and a homogenous mode pressure value are set (S20, S30).

The detection of the engine torque and the engine rpm is preformed by the well-known sensors (i.e., a throttle opening sensor and an rpm sensor) mounted in the engine, and the set of th pressure value is calculated by an electronic control unit (not shown).

In the case of the initial stratified mode fuel pressure value, a weighting factor with respect to the initial stratified mode fuel pressure value is calculated according to a variation rate in effective pressure of a combustion chamber of the engine (S40), the effective pressure being detected at predetermined intervals. The calculated weighting factor is multiplied to the initial stratified mode fuel pressure value, thereby obtaining a corrected injection pressure value of the stratified charge mode (S50).

Figure 2:
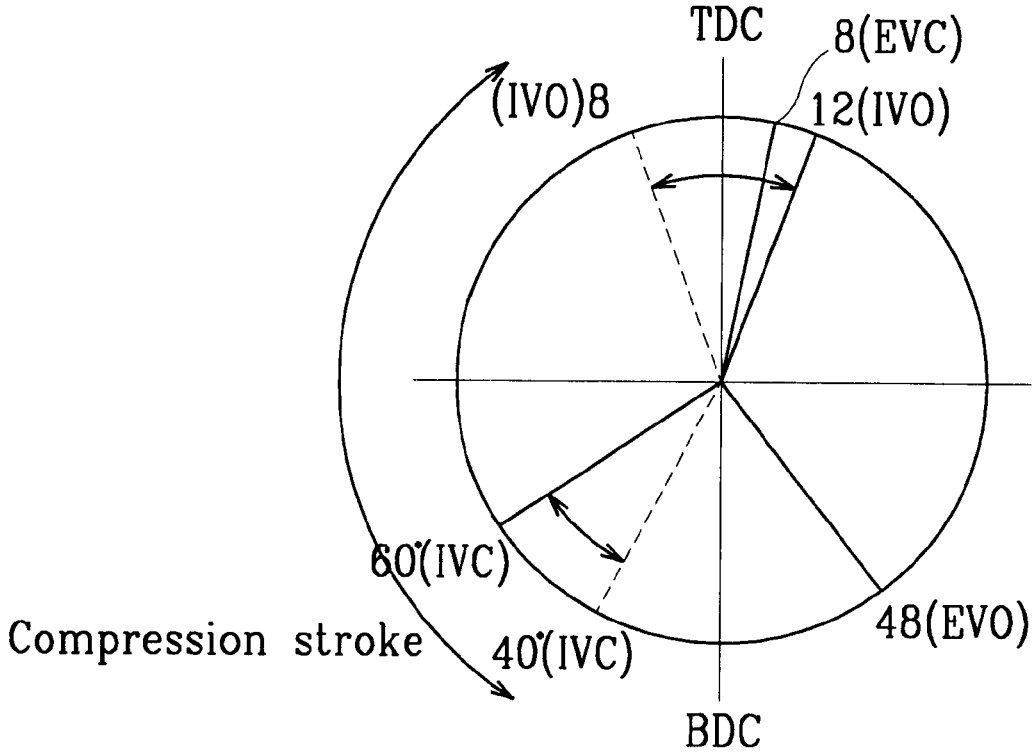
FIG. 2 is a variable valve timing diagram of a variable valve timing mechanism.
Figure 3:
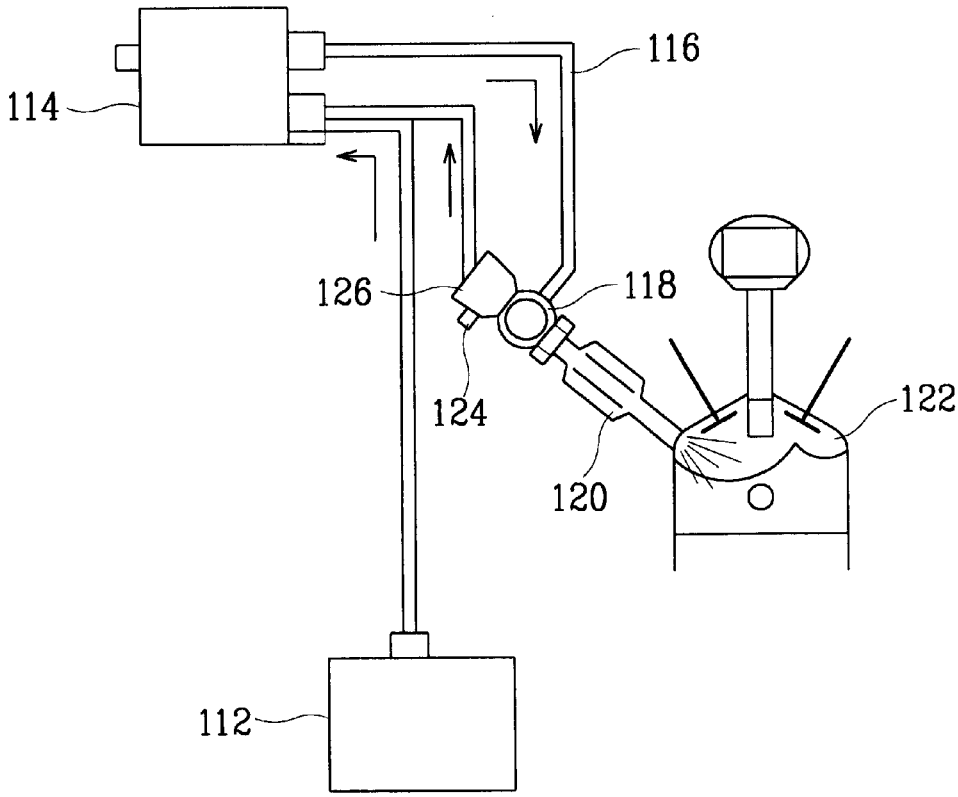
FIG.3 (Conventional Art)
FIG. 3 is a schematic view illustrating a conventional fuel supply mechanism.

Describing more in detail, the weighting factor is calculated from an inclination value which is a variation value of effective pressure values which are detected for each unit section that is obtained by dividing up a variable effective compression section of a crankshaft rotation angle. The variable compression section of the crankshaft rotation angle is generally within a range of about 40–60 degrees after the crankshaft rotates over a bottom dead center as shown in FIG. 2. The unit sections are preferably obtained by dividing the variable compressing section into 1° increments.

After the corrected stratified mode fuel pressure value is set by multiplying the weighting factor to th initial stratified mode fuel pressure value (S50), a drive mode is input (S60). According to the input drive mode, one of the corrected stratified pressure value and the homogenouse pressure value is selected (S70). The selected pressure value is compared with a current fuel pressure value detected by a pressure sensor mounted on a pressure control valve (S80). According to the result of the comprision, a final fule pressure value is set (S90).

As described above, since the injection pressure is set considering the variation of the effective compression ratio of the combustion chamber, the injection amount of fuel can be optimally adjusted, thereby reducing emissions and improving engine efficiency.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An injection pressure control method of a GDI engine comprising the steps of:

detecting an engine torque and an engine rpm;

setting an initial stratified mode fuel pressure value according to the detected engine torque and engine rpm;

calculating a weighting factor according to a variation rate in effective pressure of a combustion chamber of the engine;

establishing a corrected stratified mode fuel pressure value by multiplying the wighting factor to the initial stratified mode fuel pressure value;

comparing the corrected stratified mode fuel pressure value with a current fuel pressure value; and calculating a final fuel pressure value according to the comparision result.

2. An injection pressure control method of claim 1 wherein the step of calculating the weighting factor comprises the steps of:

dividing a variable compression section of a crankshaft rotation angle into a predetermined number of unit sections;

detecting a variation ratio in the effective pressure in the unit sections; and setting the variation ratio as the weighting factor.

3. An injection pressure control method of claim 2 wherein the variable compression section is within a range of 40–60° of a crank angle after bottom dead center.

4. An injection pressure control method of claim 3 wherein the predetermined number of unit sections is about 20.

* * * * *